US005135784A

United States Patent [19]

Okumura

[11] Patent Number: 5,135,784

[45] Date of Patent: Aug. 4, 1992

[54] WRAPPING WEB CONTAINER AND CUTTER FOR CUTTING WRAPPING WEB

[75] Inventor: Eitaro Okumura, Kyoto, Japan

[73] Assignee: Ayako Okumura, Kyoto, Japan

[21] Appl. No.: 560,743

[22] Filed: Jul. 31, 1990

[51] Int. Cl.[5] ..... B29D 22/00; B29D 23/00; B32B 1/04; B65D 5/00

[52] U.S. Cl. ..... 428/34.2; 225/43; 225/49; 225/91; 428/192; 428/507; 428/511; 428/514; 493/51; 493/110; 493/148

[58] Field of Search ..... 225/43, 49, 91; 428/34.2, 507, 192, 511, 514; 493/51, 110, 148

[56] References Cited

U.S. PATENT DOCUMENTS 4,234,635 11/1980 Atkinson ..... 428/80
4,272,590 6/1981 Blank ..... 428/460
4,371,104 2/1983 Korte ..... 225/48
4,386,193 3/1983 Reich et al. ..... 526/298

FOREIGN PATENT DOCUMENTS 53-90532 7/1978 Japan .
0294429 11/1989 Japan .

*Primary Examiner*—Paul J. Thibodeau
*Assistant Examiner*—D. S. Nakarani
*Attorney, Agent, or Firm*—Cushman, Darby & Cushman

[57] ABSTRACT

A cutting tool for use on a wrapping web container containing a roll of a web for wrapping foods or the like. The cutting tool has a member made of a piece of paper having a toothed portion with teeth in the form of saw-teeth, the toothed portion having been hardened by being immersed in a liquid containing an alkyl α-cyanoacrylate and dried.

15 Claims, 3 Drawing Sheets

WRAPPING WEB CONTAINER AND CUTTER FOR CUTTING WRAPPING WEB

BACKGROUND OF THE INVENTION

The present invention broadly relates to a wrapping web container and a cutting tool provided on the container. More particularly, the present invention is concerned with a container for containing a roll of a wrapping web such as a wrapping film, aluminum foil or thin sheet of paper for wrapping foods, drugs and so forth, and a cutter provided on the container and adapted for cutting the wrapping material after any length of the wrapping web has been unrolled and extracted from the container.

A wrapping web container is known in which a wrapping web such as a wrapping film, aluinum foil, a thin paper sheet, e.g., glassine paper or paper processed from glassine, or the like (referred to generally as web hereinafter), is contained in the form of a roll, the web being unrolled and extracted a desired length suitable for wrapping an object such as food, a drug or the like. Usually, this type of container comprises a paper box provided with a metallic cutter for cutting and severing the extracted portion of the web.

FIG. 1 illustrates one of the conventional wrapping web containers of the kind described above. As will be seen from this Figure, the wrapping web container 1 has a box-like structure of paper, the container 1 being composed of an open-top container portion 3 for containing a roll 2 of a wrapping web such as a wrapping film or an aluminum foil for wrapping mainly foods, and a lid portion 4 connected to the container portion 3 and foldable and swingable along the axis of a folding line 6. The container 1 also has a series of cutting teeth in the form of saw teeth, which is formed on one longitudinal edge thereof. The cutting tool 5 is fixed onto the bottom surface of the container portion 3 such that the teeth slightly and forwardly project from the front wall of the container portion 3.

However, this type of wrapping web container suffers from a problem in that, when it is disposed of and burnt together with other paper trash, the metallic cutting tool remains unburnt. It would be possible to separate the cutting tool before burning the container, but such separation would require some troublesome work. Thus, the known wrapping web container has posed a problem as regards the difficulty of burning it, regardless of whether the burning is conducted in a household trash burner or a public incinerator.

Another problem is that, since the saw-like teeth provided on the cutting tool are metallic teeth projected forwardly from the front wall of the container, the user's hand can be sometimes injured by these teeth when separating a desired length of web after extraction of the same from the container.

Furthermore, the cutting tool made of any metal tends to become rusty, which is quite inconvenient from the view point of health, particularly when the web is used for wrapping foods.

Japanese Utility Model Publication No. 47-34588 discloses a container for containing a roll of soft aluminum foil, in which a cutting tool with saw-teeth-like cutting teeth are integrally formed on the upper edge of the front wall. In the production of this wrapping web container, a solution composed mainly of sodium silicate or an epoxy resin or the like is applied to the toothed upper edge of the front wall of the container and the toothed edge is then dried to form a cutting tool portion having a comparatively high rigidity.

Japanese Patent Publication No. 48-36392 also shows a similar cutting tool in which a cutting tool portion is formed by dipping a toothed edge of the container wall in a solution suspending a hardening agent such as glass powder and then drying and hardening the solution to impart a considerably high rigidity to the toothed portion.

The cutting tools of the above containers formed integrally with the container boxes might be advantageous in that they are soft as compared with conventional metallic cutting tools and in that they are free of rust generation. However, these cutting tools fail to provide a cutting tool having sufficiently high strength and sharpness because a film or membrane of a resin or the like is formed on the cutting teeth. In addition, the production of the containers with such cutting tools requires a considerably long and relatively complicated process after dipping the toothed portion in a resin or applying a resin to it, because of the necessity for leaving the toothed portion under a high temperature during the long period of time needed for the drying and hardening of it.

SUMMARY OF THE INVENTION

Accordingly, an object of the present invention is to provide a non-metallic cutting tool for use in a wrapping web container which can be burnt together with the container and which is superior both as regards safety and sanitation, as well as strength and sharpness.

Another object of the present invention is to provide a non-metallic cutting tool for use on a wrapping web container which can be produced in a relatively short time by a simple production process.

To these ends, according to one aspect of the present invention, there is provided a cutting tool for use on a wrapping web container containing a roll of wrapping web, comprising a member made of a piece of paper having a toothed portion with teeth in the form of saw-teeth, the toothed portion having been immersed in a liquid containing an $\alpha$-cyanoacrylate so that the toothed portion is hardened.

Preferably, the cutting tool is provided on an upper edge portion of a front wall of an open-top container portion of the wrapping web container.

According to another aspect of the present invention, there is provided a wrapping web container having a container portion capable of receiving a roll of wrapping web and provided with an opening through which the unrolled web is extracted, comprising a toothed portion with a plurality of saw-teeth-like teeth for transversely cutting the web, the toothed portion being formed along the upper edge of the front wall of the container portion and having been hardened by an $\alpha$-cyanoacrylate.

Preferably, a tabular member is provided in the opening for separating the leading end portion of the web from the roll and for preventing the roll from being lifted.

These and other objects, features and advantages of the present invention will become clear from the following description of the preferred embodiments when the same is read in conjunction with the accompanying drawings.

DESCRIPTION OF THE PREFERRED EMBODIMENTS

Preferred embodiments of the present invention will be described with reference to the accompanying drawings.

Figure 1:
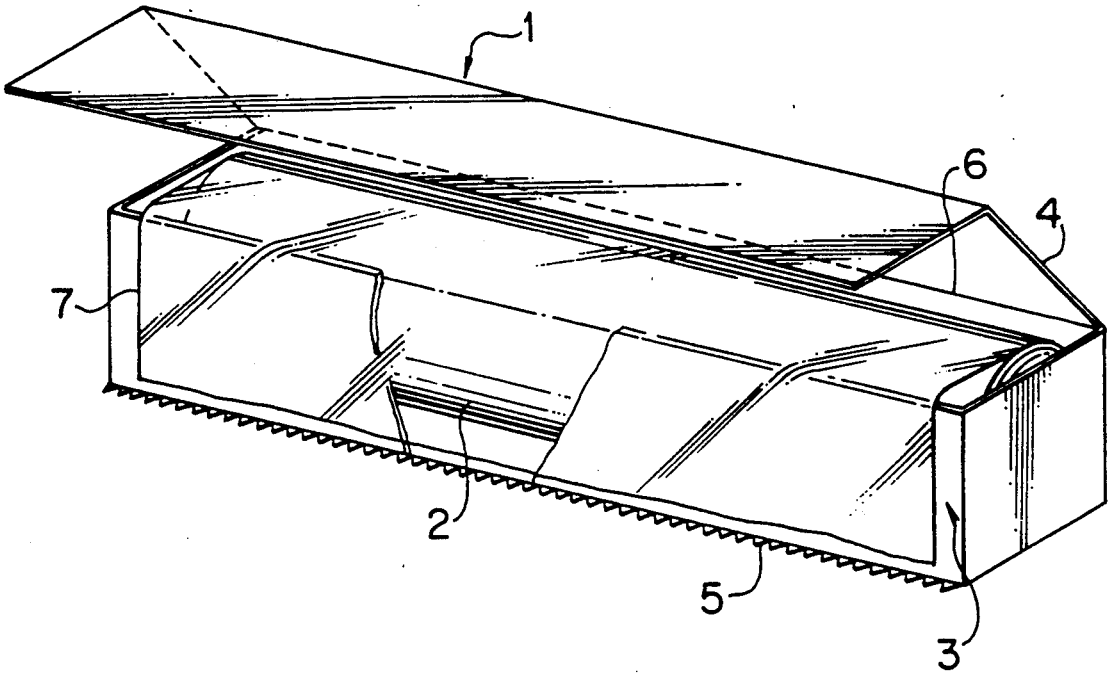
FIG. 1 (PRIOR ART)
FIG. 1 is a partialy-cutaway schemataic perspective view showing a conventional wrapping web container for containing a roll of a wrapping web for wrapping foods.
Figure 2:
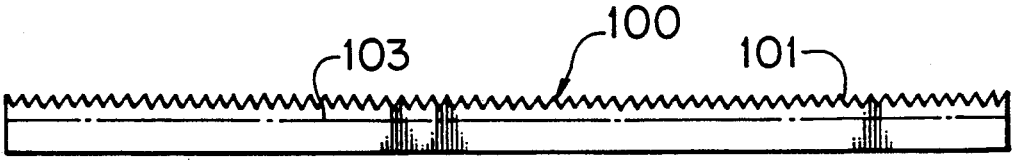
FIG. 2 is a front elevational view of a cutting tool in accordance with the present invention.

FIG. 2 is a front elevational view of a cutting tool 100 embodying the present invention, which is capable of cutting a food wrapping web such as a wrapping film, aluminum foil or paper and which can be secured to a container of such a wrapping web for severing the web.

The cutting tool 100 is made of a sheet of paper similar to the material of a wrapping web container, e.g., a cardboard, a paper board or a carton. The cutting tool 100 has a length slightly smaller than the length of the wrapping container and a height substantially the same as a conventional metallic cutting tool used for the same purpose. The cutting tool 100 is provided with saw-teeth-shaped cutting teeth 101 along the upper edge thereof formed by die cutting. The pitch of the teeth and the angle of apex of the respective teeth may be determined suitably depending on the type of the web to be cut.

In order to reinforce and stiffen the toothed portion 101 of the cutting tool 100, the toothed portion 101, at the portion thereof above an imaginary line 103 in FIG. 2, is dipped or immersed in a bath of cyano acrylic adhesive, e.g., alkyl α-cyanoacrylate such as ethyl α-cyanoacrylate, and is dried substantially naturally, whereby the toothed portion 101 is hardened and stiffened to have a desirable rigidity sufficient cut the wrapping web.

Figure 3:
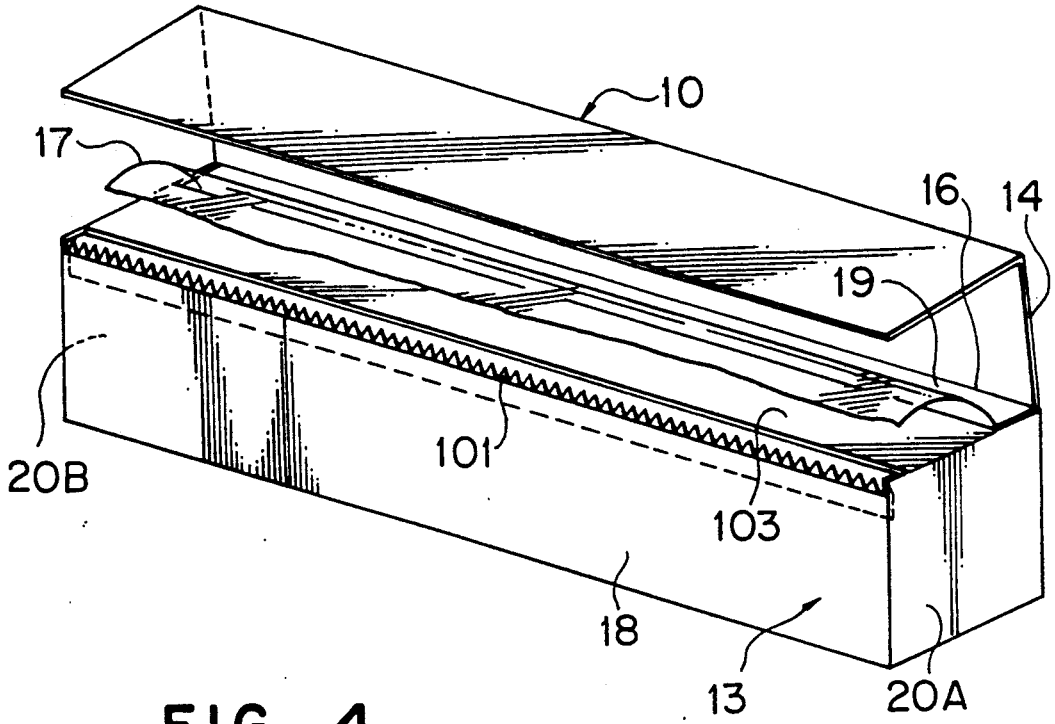
FIG. 3 is a schematic perspective view showing an embodiment of a food wrapping web container having a cutting tool in accordance with the present invention.
Figure 4:
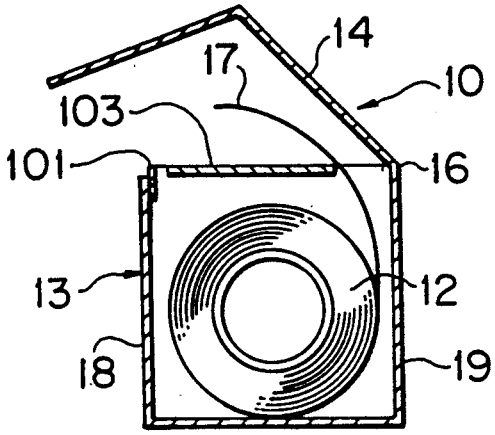
FIG. 4 is a schematic vertical sectional view of the wrapping web container shown in FIG. 3.

FIGS. 3 and 4 show a wrapping web container having the teeth 101 of this embodiment respectively. The wrapping container 10 is composed of two portions: namely, an open-top container portion 13 made of a cardboard or paperboard and capable of receiving a roll 12 of a wrapping web, the container portion 13 having a length slightly greater than the length of the roll 12, a width and height slightly greater than the diameter of the roll 14, and a lid portion 14 integral with a rear wall 19 of the container portion 13, the lid portion 14 being adapted to fold and swing about a hinge provided by a folding line 16. The aforementioned teeth 101 for cutting the web 17 in the transverse direction are formed along the upper edge of a front wall 18 of the container portion 13.

The container 10 also has a tabular member 103 provided in the opening of the container portion 13 and capable of separating a leading portion of the web 17 from the roll 12 and preventing the roll 12 from being lifted.

Figure 5:
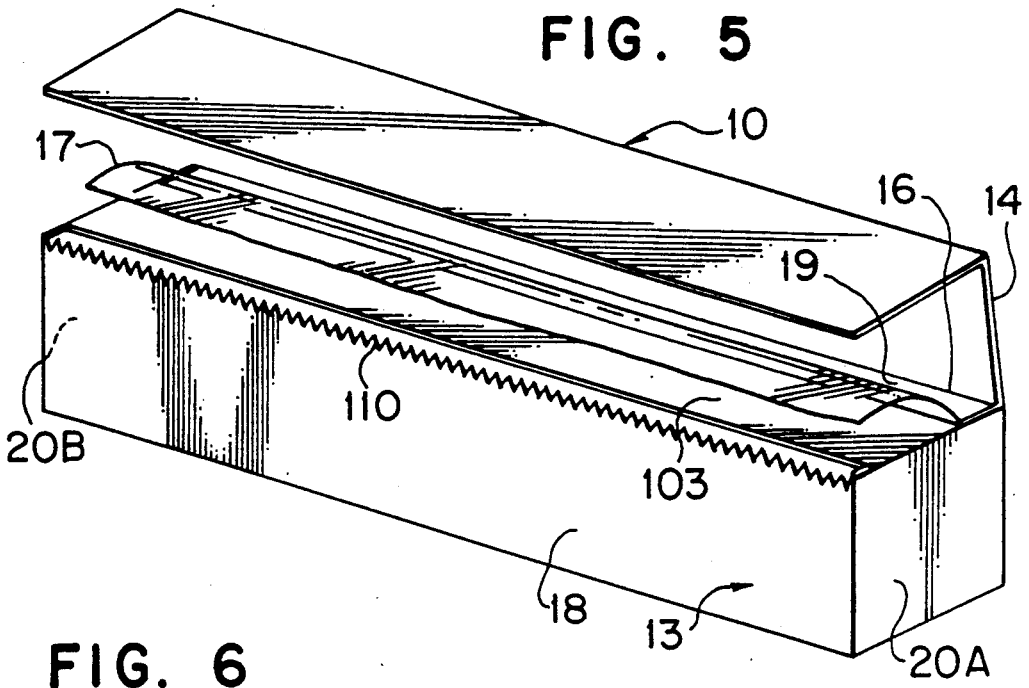
FIG. 5 is a schematic perspective view showing a wrapping web container having web cutting teeth formed integrally therewith in accordance with another embodiment of the present invention.
Figure 6:
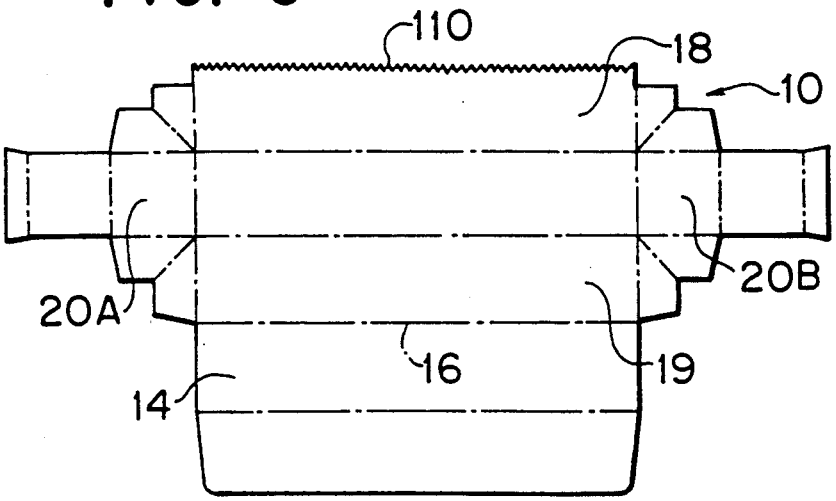
FIG. 6 is a unfolded view of the wrapping web container shown in FIG. 5.
Figure 7:
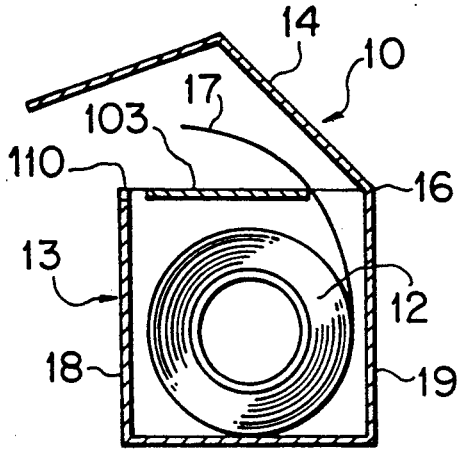
FIG. 7 is a schematic vertical sectional view of the wrapping web container shown in FIG. 5.

FIGS. 5, 6 and 7 show another embodiment of the wrapping web container of the present invention, in which the teeth for transversely cutting the wrapping web are directly formed on the upper edge of the container portion 13 of the wrapping web container 10. The wrapping container 10 is composed of two portions: namely, the open-top container portion 13 made of a cardboard or paper board and capable of receiving a roll 12 of a wrapping web, the container portion 13 having a length slightly greater than the length of the roll 12, a width and height slightly greater than the diameter of the roll 12, and the lid portion 14 integral with the rear wall 19 of the container portion 13, the lid portion 14 being adapted to fold and swing about a hinge provided by a folding line 16. Teeth 110 for cutting the web 17 in the transverse direction are formed along the upper edge of the front wall 18 of the container portion 13. During the production process of the container, a blank for the container being unfolded and having teeth 110 thereon, as shown in FIG. 6, is immersed in an alkyl α-cyanoacrylate, e.g., ethyl α-cyanoacrylate, and is then substantially naturally dried to exhibit a hardness sufficient to cut the web.

The container 10 also has the tabular member 103 provided so as to extend transversely along the opening of the container portion 13, and the tabular member 103 is capable of separating the leading portion of the web 17 from the roll 12 and preventing the roll 12 from being lifted. The tabular member 103 is secured to end walls 20A, 20B of the container portion 13 by means of, for example, any adhesive.

The cutting tool 100 of the described embodiments are made of cardboard or paper board having teeth 101, 110, and the teeth 101, 110 are hardened by being dipped in a bath of alkyl α-cyanoacrylate and naturally dried. The teeth 101, 110 thus hardened exhibit a strength substantially the same as that of conventional metallic cutting tools, by virtue of impregnation of the teeth 101, 110 with alkyl α-cyanoacrylate. Furthermore, alkyl α-cyanoacrylate exhibits a quick drying characteristic so that it hardens the teeth 101, 110 instantaneously without requiring a drying process at high temperature, thus contributing to a reduction in the time required for the production of the same.

It is, of course, possible to leave the teeth 101, 110 in an atmosphere under a high temperature after impregnation with alkyl α-cyanoacarylate. In such a case, the time required for the production thereof may be further shortened.

The cutting tool 100 thus produced can be burnt together with the container and reduces any undesirable effect on health because it does not rust, in contrast to the conventional metallic cutting tools.

Furthermore, the tabular member 103 provided along the opening of the container portion 13 effectively keeps the leading end of the web apart from the roll 12 so as to prevent the leading end from clinging around the roll, and further, this avoids the lifting of the roll 12 when the unrolled web is pulled upwardly from the roll 12.

Although the invention has been described in specific terms, it is to be understood that the described embodiments are only illustrative and various changes and modifications may be imparted thereto without departing from the scope of the invention which is limited solely by the appended claims.

For instance, in place of ethyl α-cyanoacrylate used in the described embodiments, there can be used one of the following α-cyanoacrylates represented by the formula (I) or (II);

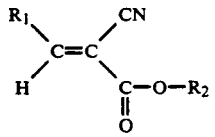

(I)

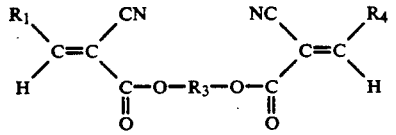

(II)

wherein $R_1$ and $R_4$ are each independently a hydrogen atom or a vinyl group, $R_2$ is an alkyl group, an alkenyl group, an alkynyl group, a cycloalkyl group, an aryl group or a tetrahydrofuryl group, which may have a substituent, $R_3$ is an alkylene group or an arylene group, which may have a substituent. These compounds can be used singly or in combination.

The following α-cyanoacrylates can be preferably used; 1-methylheptyl α-cyanoacrylate, i-propyl α-cyanoacrylate, i-butyl α-cyanoacrylate, s-butyl α-cyanoacrylate, butyl α-cyanoacrylate, 2-ethylhexyl α-cyanoacrylate, 1-ethylpropyl α-cyanoacrylate, neopentyl α-cyanoacrylate, 2,2-dimethylbutyl α-cyanoacrylate, cyclohexyl α-cyanoacrylate, allyl α-cyanoacrylate, propyl α-cyanoacrylate, methyl α-cyanoacrylate, methoxyethyl α-cyanoacrylate, ethoxyethyl α-cyanoacrylate, 2-chloroethyl α-cyanoacrylate, ethoxycarbomethyl α-cyanoacrylate, trifluoroethyl α-cyanoacrylate, 1-cyanocarbomethoxybutadiene-1,3, 1-cyanocarboethoxybutadiene-1,3, 1-cyanocarboisobutoxy-butadiene-1, 3, ethylene glycol-bis(α-cyanoacrylate), trans-2-buten-1,4-diol bis(α-cyanoacrylate), 2,5-hexanediol bis-(α-cyanoacrylate), ethyleneglycol di(1-cyanobutadiene-1,3) carboxylic acid ester, propyleneglycol di(1-cyanobutadiene-1,3) carboxylic acid ester, diethyleneglycol di(1-cyanobutadiene-1,3)carboxylic acid ester or the like.

Instead of immersing the toothed portion of the cutting tool in a bath of α-cyanoacrylate, it is possible to apply α-cyanoacrylate to the toothed portion. It is also possible to adopt various other drying methods although a natural drying method has been specifically mentioned.

What is claimed is:

1. A cutting tool for use on a wrapping web container containing a roll of wrapping web, comprising a member made of a piece of paper having a toothed portion, said toothed portion having been cut to have a saw-teeth shape, then immersed in a liquid α-cyanoacrylate bath α-cyanoacrylate so as to be impregnated with the α-cyanoacrylate, and then removed from the bath and dried, whereby the toothed portion is hardened and stiffened to a rigidity sufficient to cut the wrapping web.

2. A wrapping web container having a cutting tool according to claim 1, wherein said container has an open-top container portion containing a roll of wrapping web and having an opening through which said web is extracted, and wherein said cutting tool has a length smaller than that of said container portion.

3. A wrapping web container made of paper and having a cutting tool according to claim 1, wherein said paper member forming said cutting tool is of substantially the same thickness and material as said paper forming said container.

4. A cutting tool according to claim 1, wherein said toothed portion is naturally dried after removal from the bath.

5. A cutting tool according to claim 2, wherein said cutting tool is provided on the upper edge of a front wall of said container portion.

6. A wrapping web container made of paper and having a container portion capable of receiving a roll of wrapping web and provided with an opening through which unrolled web is extracted, comprising a toothed portion for transversely cutting the web, said toothed portion being formed at said opening and having been cut to have a saw-teeth shape, then immersed in a liquid α-cyanoacrylate bath so as to be impregnated with the α-cyanoacrylate and then removed from the bath and dried, whereby the toothed portion is hardened and stiffened to a rigidity sufficient to cut the wrapping web.

7. A wrapping web container according to claim 4, wherein said toothed portion had been immersed in a liquid containing an α-cyanoacrylate and then dried naturally.

8. A wrapping web container according to claim 6, wherein said toothed portion is provided substantially over the entire length of said upper edge.

9. A wrapping web container according to claim 6, further comprising separating means at the opening of the container portion for a leading end portion of the web from the roll and preventing the roll from being lifted.

10. A wrapping web container according to claim 9, wherein said separating means comprises a tabular member secured to said container portion and extending in the longitudinal direction of said opening throughout the entire length thereof.

11. A cutting tool according to claim 1, wherein said α-cyanoacrylate is represented by the following formula (I) or (II);

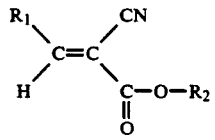

(I)

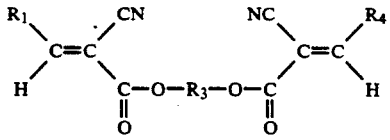

(II)

wherein $R_1$ and $R_4$ are each independently a hydrogen atom or a vinyl group, $R_2$ is an alkyl group, an alkenyl group, an alkynyl group, a cycloalkyl group, an aryl group or a tetrahydrofuryl group, which may have a substituent, and $R_3$ is an alkylene group or an arylene group, which may have a substituent.

12. A cutting tool according to claim 1, wherein said α-cyanoacrylate is selected from the group consisting of 1-methylheptyl α-cyanoacrylate, i-propyl α-cyanoacrylate, i-butyl α-cyanoacrylate, s-butyl α-cyanoacrylate, butyl α-cyanoacrylate, 2-ethylhexyl α-cyanoacrylate, 1-ethylpropyl α-cyanoacrylate, neopentyl α-cyanoacrylate, 2,2-dimethylbutyl α-cyanoacrylate, cyclohexyl α-cyanoacrylate, allyl α-cyanoacrylate, propyl α-cyanoacrylate, methyl α-cyanoacrylate, methoxyethyl α-cyanoacrylate, ethoxyethyl α-cyanoacrylate, 2-chloroethyl α-cyanoacrylate, ethoxycarbomethyl α-cyanoacrylate, trifluorethyl α-cyanoacrylate, 1-cyanocarbomethoxybutadiene-1,3, 1-cyanocarboethoxybutadiene-1,3, 1-cyanocarboisobutoxybutadiene-1,3, ethyleneglycol-bis(α-cyanoacrylate), trans-2-buten-1,4-diol bis(α-cyanoacrylate), 2,5-hexanediol bis(α-cyanoacrylate), ethyleneglycol di(1-cyanobutadiene-1,3) carboxylic acid ester, propyleneglycol di(1-cyanobutadiene-1,3) carboxylic acid ester, and diethyleneglycol di(1-cyanobutadiene-1,3)carboxylic acid ester.

13. A wrapping web container according to claim 6, wherein said α-cyanoacrylate is represented by the following formula (I) or (II):

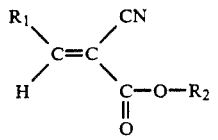

(I)

-continued

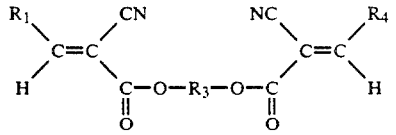

(II)

wherein $R_1$ and $R_4$ are each independently a hydrogen atom or a vinyl group, $R_2$ is an alkyl group, an alkenyl group, an alkynyl group, a cycloalkyl group, an aryl group or a tetrahydrofuryl group, which may have a substituent, and $R_3$ is an alkylene group or an arylene group, which may have a substituent.

14. A wrapping web container according to claim 6, wherein said α-cyanoacrylate is selected from the group consisting of 1-methylheptyl α-cyanoacrylate, i-propyl α-cyanoacrylate, i-butyl α-cyanoacrylate, s-butyl α-cyanoacrylate, butyl α-cyanoacrylate, 2-ethylhexyl α-cyanoacrylate, 1-ethylpropyl α-cyanoacrylate, neopentyl α-cyanoacrylate, 2,2-dimethylbutyl α-cyanoacrylate, cyclohexyl α-cyanoacrylate, allyl α-cyanoacrylate, propyl α-cyanoacrylate, methyl α-cyanoacrylate, methoxyethyl α-cyanoacrylate, ethoxyethyl α-cyanoacrylate, 2-chloroethyl α-cyanoacrylate, ethoxycarbomethyl α-cyanoacrylate, trifluoroethyl α-cyanoacrylate, 1-cyanocarbomethoxybutadiene-1,, 1-cyanocarboethoxybutadiene-1,3, 1-cyanocarboisobutoxybutadiene-1,3, ethyleneglycol-bis(α-cyanoacrylate), trans-2-buten-1,4-diol bis(α-cyanoacrylate), 2,5-hexanediol bis(α-cyanoacrylate), ethyleneglycol di(1-cyanobutadiene-1,3) carboxylic acid ester, propyleneglycol di(1-cyanobutadiene-1,3) carboxylic acid ester, and diethyleneglycol di(1-cyanobutadiene-1,3)carboxylic acid ester.

15. A cutting tool for use on a wrapping web container containing a roll of wrapping web, comprising a member made of a piece of paper having a toothed portion with teeth in the form of saw-teeth, said toothed portion being dry and impregnated with an α-cyanoacrylate so as to be hard and sufficiently rigid to cut the wrapping web.

* * * * *